US005173564A

United States Patent [19]

Hammond, Jr.

[11] Patent Number: 5,173,564

[45] Date of Patent: Dec. 22, 1992

[54] QUICK DETACHABLE STOCK SYSTEM AND METHOD

[76] Inventor: Claude R. Hammond, Jr., 604 Audubon Cir., Belvedere, S.C. 29841

[21] Appl. No.: 817,634

[22] Filed: Jan. 7, 1992

[51] Int. Cl.[5] ..... F41C 23/14

[52] U.S. Cl. ..... 42/75.03

[58] Field of Search ..... 42/75.03, 72, 73, 71.01

[56] References Cited

U.S. PATENT DOCUMENTS

| | | | |
|---|---|---|---|
| 1,755,034 | 4/1930 | Stange | 42/75.03 |
| 1,996,124 | 4/1935 | Rowley | 42/75.03 |
| 2,302,059 | 11/1942 | Roemer | 42/75.03 |
| 3,323,246 | 6/1967 | Löffler | 42/75.03 |
| 3,380,182 | 4/1968 | Browning | 42/75.03 |
| 3,683,535 | 8/1972 | Lewis | 42/75.03 |

*Primary Examiner*—David H. Brown
*Attorney, Agent, or Firm*—Joe M. Muncy

[57] ABSTRACT

A system and method for attaching a stock to and removing a stock from a receiver is readily adaptable for existing weapons such as a rifle. The system includes a mounting device with an extension and latch member. The extension can be mounted on the receiver and the latch member provided on the stock. The extension is inserted into the stock and locked with the latch member by rotation of the stock relative to the receiver. This will mount the stock to the receiver. A plunger insertable into the receiver or stock can be provided to prevent rotation of the stock relative to the receiver after the stock and receiver are mounted together. In the method, the extension is inserted into the latch member, the plunger is retracted and the stock is rotated 90° relative to the plunger. This rotation locks the extension and latch members whereby the stock is mounted to the plunger. Then, upon release of the plunger, further rotation of the stock and receiver is prevented until the plunger is again withdrawn.

24 Claims, 5 Drawing Sheets 88
86
120
122
124
114
136
138
134
64
82
81
140
84

122
124
120

126
122
124
120
XI
XI 132
128
130
114
136
138
134
82
81
140
84
118

XVI
XVI
74
76
78
80
150
152
154
156
94
96
98
158
160
162
164
104
106
128
130
504
506
508
510
82
81
84
140
178
102
166
168
170
172
174
176
144
146
148
70
72
149

60
82
184
182
180
81
140
84

186
188
190
192
194
196

198
200
202
204
140

198
200
206
218
92
94

206
208

210
212
214
216
218
219
200

210
211
214
216
218

188
221
224
226
228

230
232
234
236
238

240
242
246
248
250

240
242
246
252

QUICK DETACHABLE STOCK SYSTEM AND METHOD

BACKGROUND OF THE INVENTION

1. Field of the Invention

The present invention relates to a quick detachable stock system and method for interchanging weapon stocks.

2. Description of the Background Art

It is currently possible to exchange stocks between various weapons. For example, an AR-15 rifle or M-16 style weapon can have either a standard stock or a CAR (collapsible-type) stock system. However, in the prior art when exchanging stocks, it takes about fifteen minutes per exchange for each weapon. Therefore, a need in the art exists for a system and method by which stocks can rapidly be interchanged.

SUMMARY OF THE INVENTION

Accordingly, it is a primary object of the present invention to provide a detachable stock system and method whereby different weapon stocks can quickly and easily be interchanged.

It is another object of the present invention to provide a detachable stock system and method which can operate with many standard weapons components thereby requiring little alteration to the weapons.

It is a further object of the present invention to provide a detachable stock system and method which can easily be used by a right-handed or left-handed person.

Another object of the present invention is to provide a detachable stock system and method which is easy to use, reliable and inexpensive.

Yet another object of the present invention is to provide a detachable stock system and method which will assuredly affix the stock to the receiver of the weapon and which requires limited maintenance.

Another object of the present invention is to provide a detachable stock system and method whereby the length of collapsible-type stocks can be slightly extended such that this length will be compatible with standard-type stocks.

These and other objects of the present invention are fulfilled by a detachable stock system comprising a receiver, a stock, mounting means and locking means. The mounting means will have an extension and latch member. The extension will either be provided on the receiver or stock while the latch member will be provided on the other one of the receiver and stock. The locking means is movable between a first and second position. In the first position, rotation of the stock relative to the receiver will be prevented. However, the stock and receiver can rotate when the locking means is in the second position. The locking means is provided at an end of the stock adjacent to the receiver when the stock and receiver are mounted together.

These and other objects of the present invention are also fulfilled by a method for readily attaching a stock to and detaching a stock from the receiver. This method comprises the steps of providing an extension on either the stock or receiver. If the stock has the extension, a latch member will be provided on the receiver. On the other hand, if the receiver has the extension, the latch member will be provided on the stock. The extension is inserted into the latch member. A plunger on the stock is retracted into the stock and then the stock is rotated relative to the receiver. When a plunger and an opening on the receiver are aligned, the plunger is released in order to extend into the stock. This will prevent further rotation of the stock relative to the receiver and will lock the two together. In this position, the stock and receiver will be held together due to the extension inserted into the latch means. When it is desired to release the stock from the receiver, the plunger is retracted, the stock is rotated relative to the receiver and the extension is removed from the latch member. The stock can then be moved away from the receiver and another stock can be mounted on the receiver.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
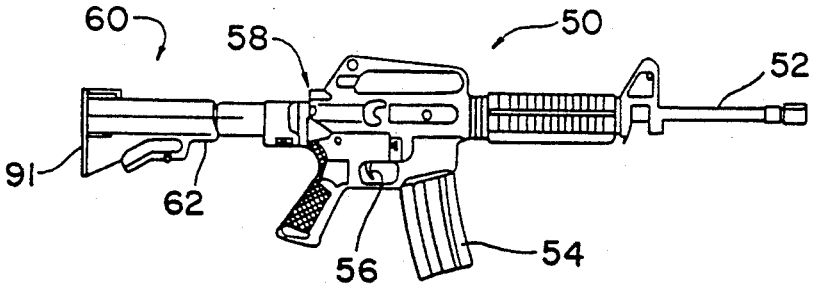
FIG. 1 is a side view of a weapon having an extended collapsible-type stock mounted thereon.

Referring in detail to the drawings and with particular reference to FIGS. 1–3, the present invention will be explained. In FIG. 1, a weapon 50 such as a rifle 50 is shown. This weapon 50 has a barrel 52, magazine 54 and trigger 56. One end of this weapon will be considered as the receiver 58. While a particular rifle has been shown in FIG. 1, it should be readily apparent that the instant detachable stock system and method can be used with many different types of weapons. For example, the instant system can be used with an AR-15 style weapon, an M-16 weapon, a shotgun, a pistol or the like. Different types of stocks or grips can also be used with this invention, such as pistol grips, folding stocks, standard-type stocks, pistol grip stocks and collapsible-type stocks. Throughout the instant specification, the term stock will be used for the rear handle of a rifle, pistol, automatic weapon, etc., to which the barrel and mechanism (the receiver) are attached.

As shown in FIG. 1, a collapsible-type stock or CAR stock 62 is shown for the stock 60. This collapsible-type stock 62 is extended in FIG. 1 and retracted in FIG. 2. In FIG. 3, a standard-type stock 64 is shown. While two types of stock will now be discussed, it should be readily apparent that many different types of stocks can be used. The instant stock system and method merely provides for an easy arrangement to quickly attach many different types of stocks to many different types of weapons.

Figure 4:
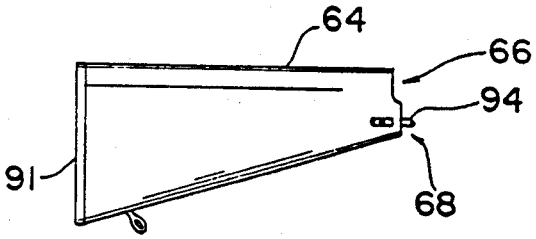
FIG. 4 is a side view of the standard-type stock.
Figure 5:
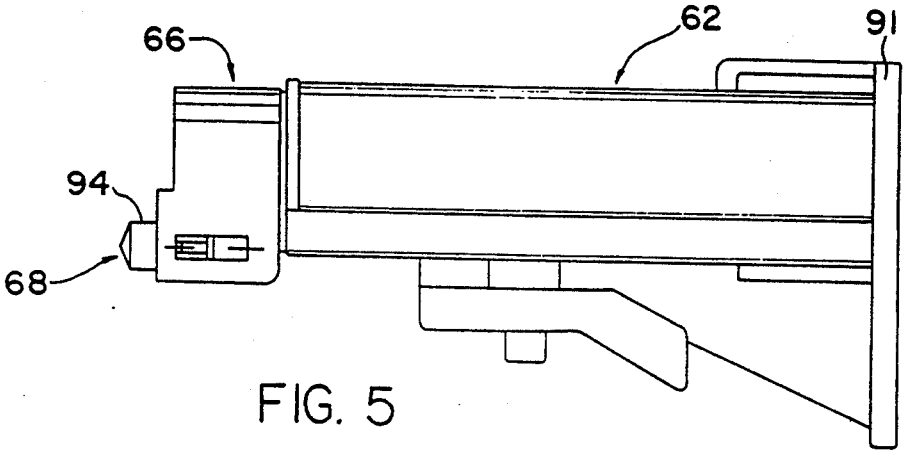
FIG. 5 is a view of the opposite side of a collapsible-type stock taken from a side opposite that shown in FIG. 2.

One side of a standard-type stock 64 is shown in FIG. 4 while a side of a collapsible-type stock 62 is shown in FIG. 5. This side in FIG. 5 is opposite to that shown in FIG. 2. It should be understood that the sides of each of these stocks 62,64 are merely mirror images. A plane along the longitudinal axes of the stocks can form a median plane. This median plane will divide the stocks bilaterally, symmetrically into right and left halves. While each side of the stocks has been described as mirror images for simplicity of description, it should be understood that the stocks can have minor variations such that the sides are not always identical mirror images.

It should also be noted that the stocks in FIGS. 4 and 5 are facing in opposite directions. In particular, the rear end of each stock has an end plate 91. Thus, the stock in FIG. 4 is facing in one direction whereas the stock in FIG. 5 is facing in an opposite direction.

A mounting means 66 and a locking means 68 are provided at the forward end of each stock. These means will now be described with reference to FIG. 6.

Figures 6, 7, 8, 8A:
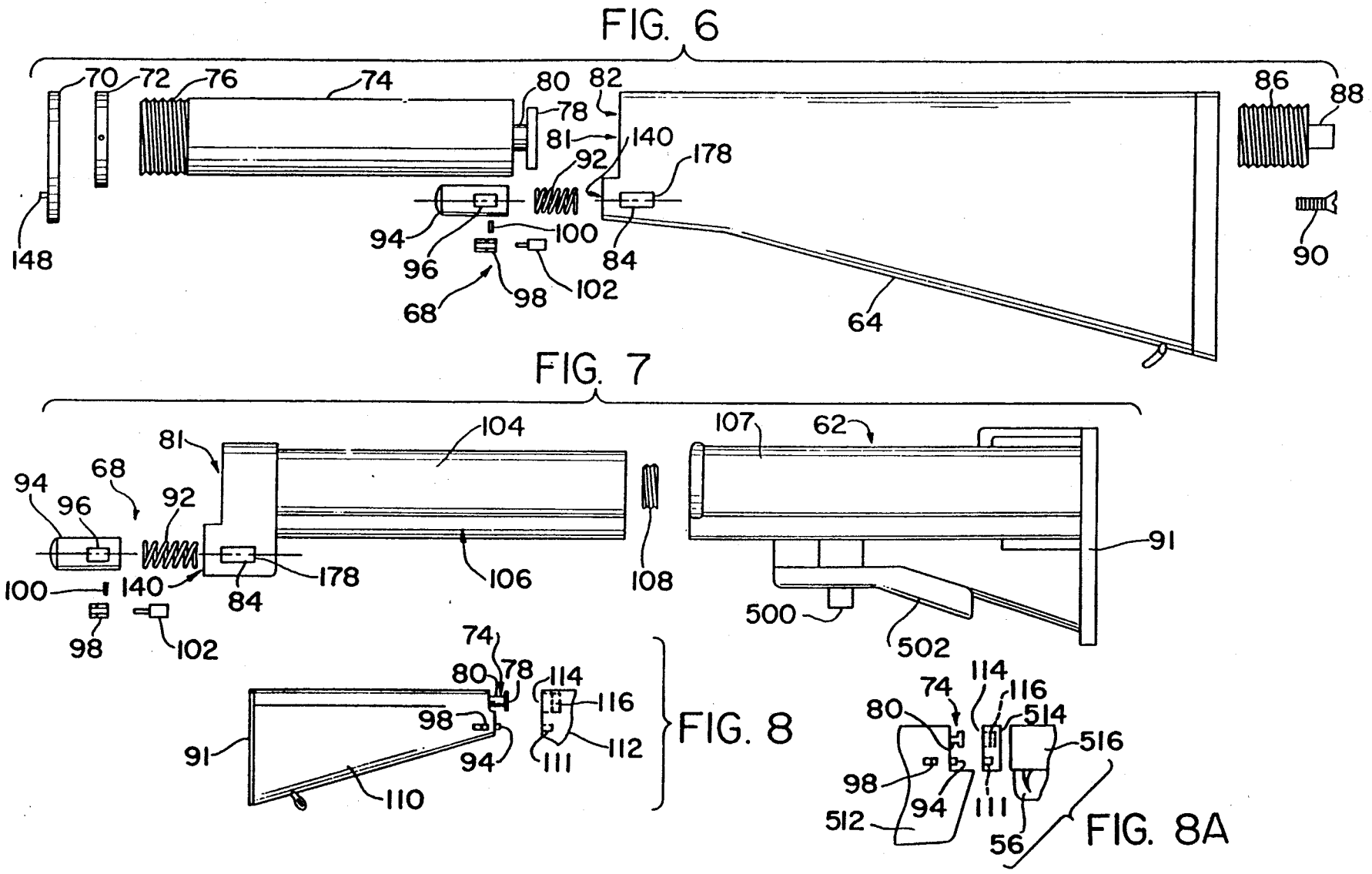
FIG. 6 is an exploded view of the quick detachable stock system of the present invention using a standard-type stock.
FIG. 7 is an exploded view of a portion of the detachable stock system of the present invention using a collapsible-type stock.
FIG. 8 is a side view of a receiver and a standard-type stock with an extension mounted thereon.
FIG. 8A is a partial side view of a receiver, a spacer and a pistol grip of the present invention.

In FIG. 6, a first receiver end plate 70 is shown. A receiver extension nut 7 is provided between this receiver end plate 70 and an extension 74. The forward end of extension 74 has a threaded end 76. In this manner, the extension 74 can be screwed through nut 72 and through receiver end plate 70 into a receiver 58. In this manner, the extension 74 can be mounted on the receiver.

It should be noted, however, that an alternate arrangement can be provided. In other words, the extension 74 can be mounted on the stock as shown in FIG. 8, for example. While this modified stock 110 is a standard-type stock, it should be realized that a collapsible-type stock or any other stock have the extension 74 attached thereto. This extension 74 will be received in a latch member 114 provided on a modified receiver 112. A plunger receiving opening 111 is also provided on this modified receiver 112. The extension 74 shown in FIG. 8 has a cap 78 with a shaft 80 therebetween. This cap 78 can be inserted through an opening in the front wall 116 of the latch member 114 as will be described in more detail with reference to FIG. 6. Once this cap 78 is inserted into the opening in the front wall 116, a plunger 94 can be received in the plunger opening 111 as will also be described with reference to the embodiment of FIG. 6.

Nonetheless, the arrangement shown in FIG. 8 indicates that the extension 74 can be mounted on the stock instead of being mounted on a receiver. This type of arrangement shown in FIG. 8 is especially suitable for stocks which do not have tubes provided therein such as shotgun stocks.

Instead of using a stock as shown in FIG. 8, a stock as shown in FIG. 8A could be used. This stock 512 is a pistol grip. A receiver extension 74 and plunger retractor 98 are provided on this stock 512 similarly to the modified stock 110 of FIG. 8. In the FIG. 8A arrangement, a spacer 514 is provided between the stock 512 and the pistol receiver 516. This spacer 514 has the latch member 114 and plunger opening 111 similarly to the modified receiver 112. The spacer 514 can be attached to the pistol receiver 516 by different arrangements such as by being screwed thereon. Once the spacer 514 is attached to the pistol receiver 516, the stock 512 can readily be attached to and detached from the spacer 514 and pistol receiver 516 combination. This attaching and detaching feature will be described in more detail below.

Returning now to FIG. 6, the extension 74 shown also has a cap 78 with a shaft 80 therebetween. The mounting means 66 includes the receiver end plate 70, the extension nut 72, the extension 74, the shaft 80, cap 78 and other elements as will be described in more detail below. The extension 74 is insertable into a tube 82 of stock 64. A cut-out forward end 81 of the stock 64 will abut against the receiver extension nut 72 when the extension 74 is inserted into tube 82.

A transverse opening 84 is provided at the forward end of the stock. At the rear end of the stock 64, a stock plug 86 is shown. This stock plug 86 has a neck 88 which receives a stock plate screw 90 which will be described in more detail below.

A plunger housing 140 is provided at the forward end of stock 64 adjacent the transverse opening 84. Within this plunger housing 140, a plunger spring 92 and plunger 94 are situated. This plunger 94 has a transverse opening 96. After this plunger 94 is inserted into the housing 140, a plunger retractor 98 will be slid through opening 84 and opening 96 in order to hold the plunger 94 in the housing 140.

A first operator grip 102 is attachable to the plunger retractor 98 by a pin 100. The plunger 94, spring 92, plunger retractor 98 and operator grip 102 are a part of the locking means 68. The operation and further design of this locking means 68 will be described in more detail below.

FIG. 7 will now be described concerning the collapsible-type stock 62. This collapsible-type stock has two sections. A housing 104 is provided at the forward end with a cut-out forward edge 81. Beneath this housing is a track 106 which will engage a runner provided in the rear end portion 107 of the collapsible-type stock 62. A plunger 500 is provided beneath rear end portion 107 for engaging stops 506, 508 and 510 in the track 106 as will be described with reference to FIG. 22. A handle 502 is provided for removing plunger 500 from the various stops to permit longitudinal movement of the housing 104 and rear end portion 107. Therefore, this stock 62 is collapsible. A housing plug 108 is provided between these sections.

The forward end of housing 104 has a transverse opening 84 similar to the standard-type stock shown in FIG. 6. A plunger housing 104 is also provided for receiving a spring 92, plunger 94, plunger retractor 98 and first operator grip 102. These components are inserted into the plunger housing 140 similarly to the arrangement shown in FIG. 6. Specifically, the spring 92 and plunger 94 are inserted into housing 140. Then, the plunger retractor 98 is slid through openings 84 and 96. The operator grip 102 is then attached to the plunger retractor 98 by pin 100. In both stocks, the plunger retractor 98 extends through both sides of the stock. In other words, an opening 84 is provided on both sides of the stock. While only one first operator grip 102 is shown in FIGS. 6 and 7, it should be recognized that each side of the plunger retractor 98 will have an operator grip 102 attached thereto as will be described in more detail below.

It should be recognized that the arrangement shown in FIG. 7 is used with the receiver end plate 70, receiver extension nut 72 and extension 74 shown in FIG. 6. A tube 82 is provided in the forward end of housing 104 into which the extension 74 will be inserted as will be described in more detail below.

Figures 9, 10, 11, 12:
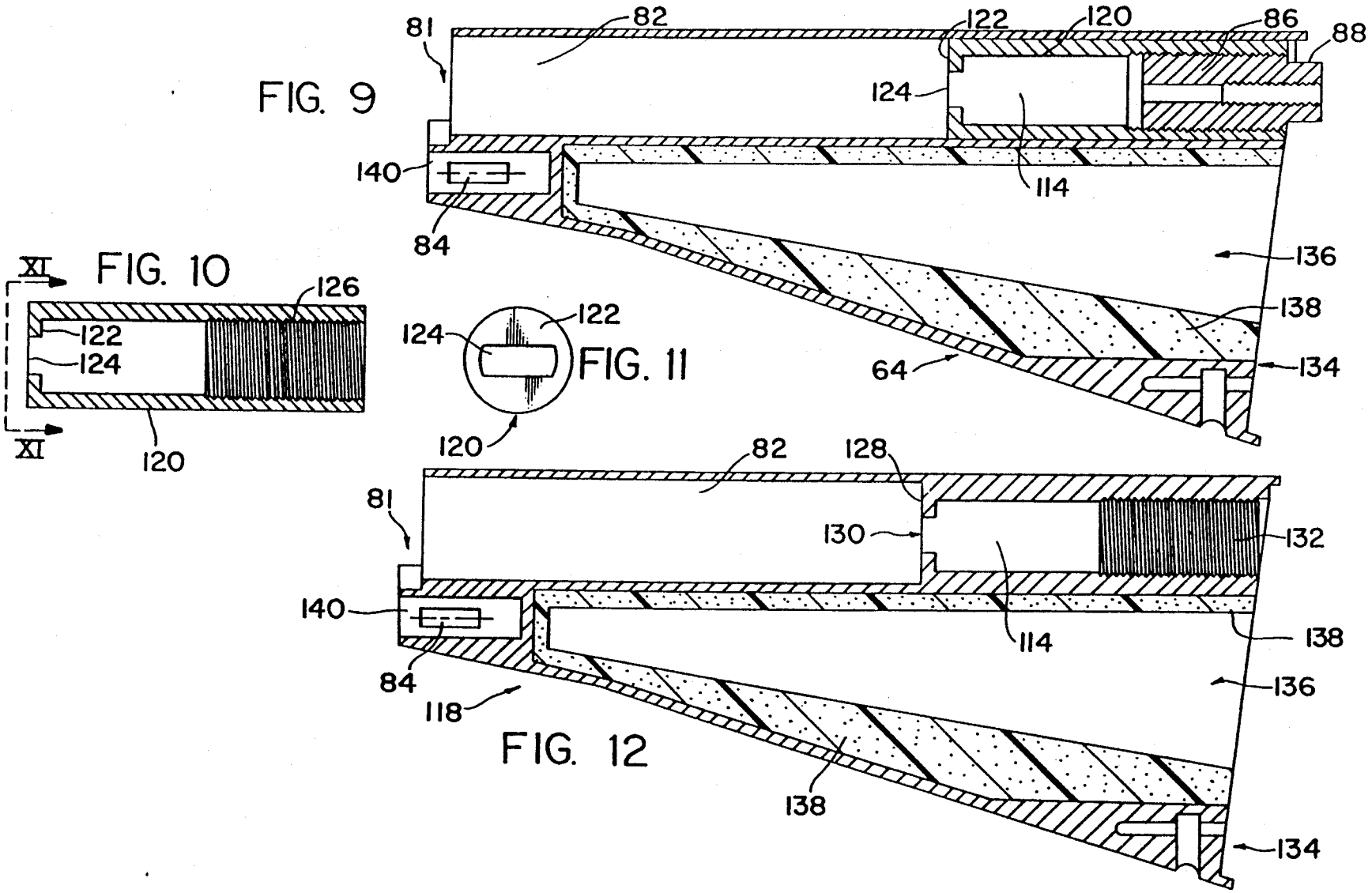
FIG. 9 is a cut-away view of a first embodiment of a standard-type stock of the present invention.
FIG. 10 is a cut-away view of a stock insert of the present invention.
FIG. 11 is an end view of the stock-insert of FIG. 10 taken along line XI—XI.
FIG. 12 is a second embodiment of a standard-type stock of the present invention.

Turning now to FIG. 9, a first embodiment of a standard-type stock 64 is shown. It can be seen that tube 82 extends along the complete length of this stock 64 from the out-out forward edge 81 to the rear. At the rear section, a recess 134 is provided. An end plate 91 will be positioned within this recess 134 as will be described in more detail below. Within tube 82 is a stock insert 120. This stock insert 120 is shown in FIG. 10. The front wall 122 of the stock insert 120 has an opening 124. The shape of this opening 124 is seen in FIG. 11. The opening has curved side walls and straight upper and lower walls. The cap 78 will be received in this opening 124 as will be described in more detail below. This stock insert 120 with opening 124 can act as a latch member 114.

At the rear of the stock insert 120 are threads 126. This stock insert 120 can be inserted into tube 82. Then, the previously described stock plug 86 can be screwed into the threaded end. The neck 88 of the plug 86 extends beyond the end of tube 82. An end plate 91 can then be positioned over this neck within recess 134. The screw 90 which is shown in FIG. 6 can then be screwed into the neck 88 of the plug 86 in order to affix the end plate 91 to the end of the stock.

A pocket 136 and a foam filled area 138 are provided within the stock 64. At the forward end of the stock 64 is the plunger housing 140 as previously described. The opposite side of transverse opening 84 can be seen in FIG. 9. One end of the plunger retractor 98 will extend through this opening 84. As previously noted, there is a transverse opening 84 on each side of the stock such that the plunger retractor 98 extends completely through the stock.

Turning now to FIG. 12, a second embodiment of a standard-type stock is shown. This molded stock 118 is similar to the arrangement shown in FIG. 9 except the stock insert 120 is no longer a separate piece. In other words, the structure of the stock insert 120 is molded into the tube 82. This molded portion has a front wall 128 with an opening 130. The shape of this opening 130 is similar to the opening 124 shown in FIG. 11. Therefore, a cap 70 having a particular shape can readily be used with either the opening 124 or opening 130 of either type of stock.

Threads 132 are molded at the end of this stock 118. This threaded end 132 will receive a plug 86 similarly to the arrangement shown in FIG. 9. The attachment of the end plate 91 into recess 134 for this molded stock 118 is similar to the attachment of the end piece 91 in the FIG. 9 arrangement. Also provided within this molded stock 118 is a pocket 136 and foam filled area 138. A plunger housing 140 and transverse opening 84 are also provided in this molded stock 118.

Referring now to FIG. 6 and FIGS. 13–21, the various components will be described in more detail. Specifically, in FIG. 13, a front view of the receiver end plate 70 is shown. This receiver end plate 70 has a first opening 144 for the extension 74. A second opening 146 is provided for plunger 94. Also provided on a forward face of this receive end plate 70 is a detent 148. This detent 148 will be positioned within a hole in the receiver 58. In that manner, the receiver end plate 70 will be prevented from rotating.

Figures 13, 14, 15, 16, 17, 18, 19, 20, 21, 22:
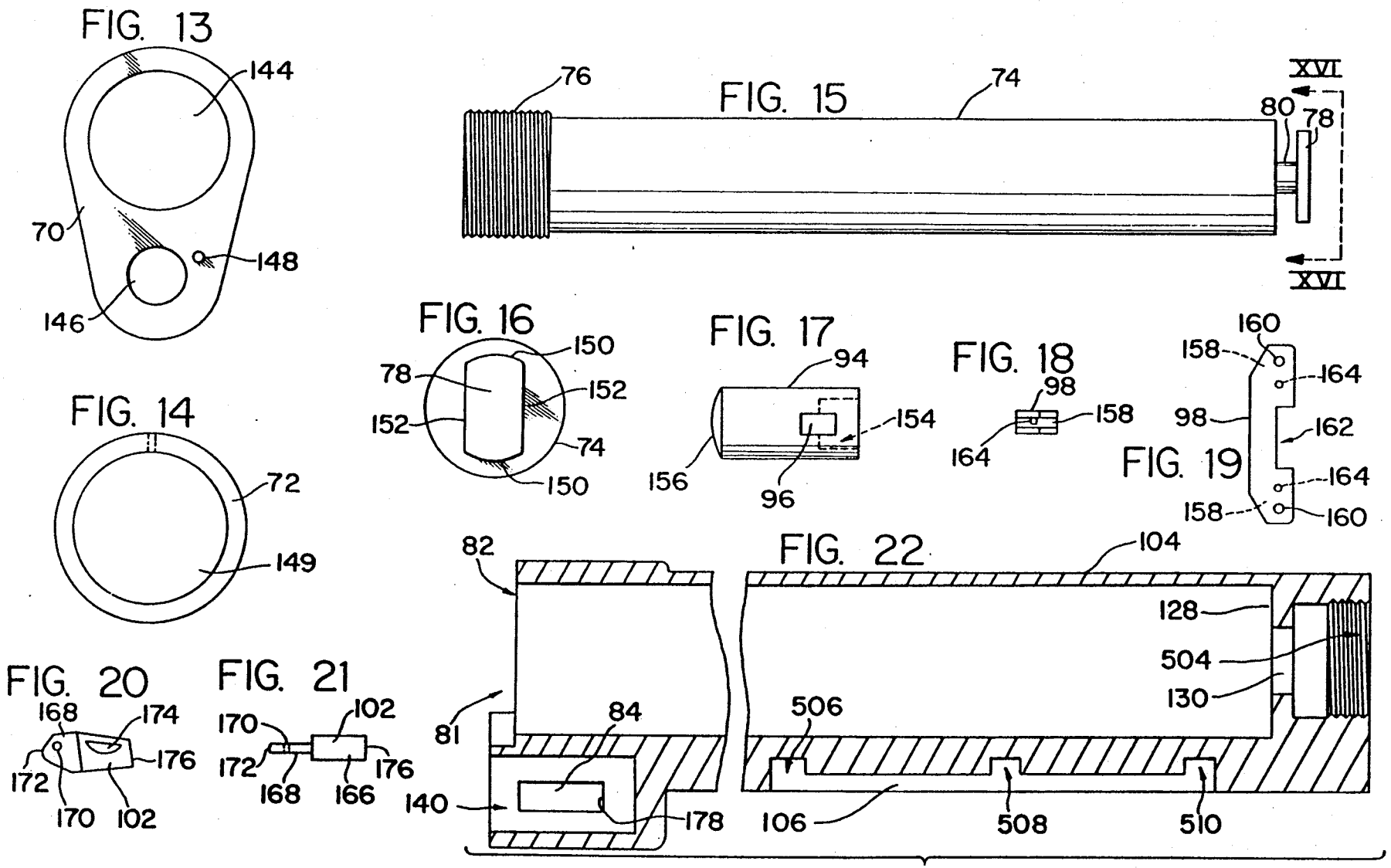
FIG. 13 is a front view of a receiver end plate of the present invention.
FIG. 14 is a front view of a receiver extension nut of the present invention.
FIG. 15 is a side view of an extension of the present invention.
FIG. 16 is an end view of the extension shown in FIG. 15 taken along line XVI—XVI.
FIG. 17 is a side view of a plunger of the present invention.
FIG. 18 is a side view of a plunger retractor of the present invention.
FIG. 19 is a top plan view of the plunger retractor shown in FIG. 18.
FIG. 20 is a top plan view of a first operator grip of the present invention.
FIG. 21 is a side view of the operator grip shown in FIG. 20.
FIG. 22 is a broken, cross-sectional view of the housing of a collapsible-type stock of the present invention.

In FIG. 14, a front view of the receiver extension nut 72 is shown. An opening 149 is provided in this nut 72. The extension 74 will extend through this opening 149 as well as the first opening 144 of the receiver end plate 70.

Turning now to FIGS. 15 and 16, the extension 74 is shown in more detail. One end of extension 74 is threaded at 76 so that this extension 74 can be screwed into either a receiver 58 or a stock 60 as previously described. FIG. 16 shows the other end of extension 74.

The cap 78 has rounded portions 150 on each side. A flat portion 152 is provided between these rounded portions. As should be recognized, the shape of this cap corresponds to the opening 124 shown in FIG. 11. This shape will also correspond to the opening 130 of the molded stock 118 shown in FIG. 12. The cap 78 can be inserted through either opening 124 or 130 when the flat portions 152 of the cap are aligned with the flat portions of the opening. Once the cap is through the opening, it can then be rotated. After the cap is rotated, it will no longer be in alignment with opening 124 or 130 such that the cap 78 is locked in position. In other words, the rounded portions 150 will engage the flat portions of the opening in order to lock the extension 74 to the latch member 114. This operation of locking the extension 74 to the latch member 114 will be described in more detail below.

Turning now to FIG. 17, the plunger 94 is shown in more detail. The transverse opening 96 is indicated in this view. This transverse opening extends completely through the plunger so that the plunger retractor 98 can be positioned therein. A forward rounded end wall 156 of the plunger is shown. The forward end of the plunger 94 having this rounded end 156 will extend from the stock into an opening provided in the receiver. Such an opening 111 is shown, for example, in FIG. 8.

As shown in FIG. 17, a counter bore 154 is provided at the rear end of plunger 94. The spring 92 can be received within this counter bore. This will help to maintain alignment between the spring 92 and the plunger 94.

Turning now to FIGS. 18 and 19, side and top-plan views of the plunger retractor 98 are shown, respectively. A slot 158 is provided on both sides of the plunger retractor 98. An opening 160 will extend through the plunger retractor through this slot 158. This opening 160 will serve as a pivot for the first operator grip 102 as will be described in more detail below.

At the rear of plunger retractor 98 is a recess 162. When the plunger retractor 98 is inserted through the transverse opening 96 of the plunger 94, the spring 92 can be inserted through counter bore 154 into engagement with this recess 162. This will help to maintain the positioning of the plunger retractor 98 within the plunger 94.

Within slot 158 are detents 164. These detents 164 will help hold the first operator grips 102 in position. It should be recognized that a set of pivots 160 and slots 158 and detents 164 are provided. In other words, each side of the plunger retractor 98 will receive a first operator grip 102.

One of these operator grips 102 is shown in FIGS. 20 and 21. This operator grip 102 has a body portion 166 and an end 168. At the end 168 is an opening 170. This opening 170 will be aligned with one of the openings 160 in the plunger retractor 98. A pin 100 can then be inserted through these openings in order to hold the first operator grip 102 in position. Therefore, each side of the plunger retractor 98 can have a first operator grip 102 attached thereto.

The forward edge 172 of the operator grip 102 will act as a camming surface. In other words, this edge will engage detent 164 in order to hold the operator grip 102 in either a retracted or an extended position. In the retracted position, a longitudinal axis of the first operator grip 102 will be somewhat parallel to a longitudinal axis of the plunger retractor 98. An operator can grasp the grips 102 by the finger grip 174. Each grip can then be independently rotated about the pin 100 extending through openings 160 and 170. In this manner, the operator grips 102 can be moved from the retracted position to the extended position. In the extended position, the longitudinal axis of the grip 102 will form an acute angle with the longitudinal axis of the plunger retractor 98. Alternatively, the grips can be rotated 90° such that the longitudinal axes of the plunger retractor 98 and grips 102 are perpendicular. The first operator grips 102 can freely be moved between these retracted and extended positions.

In the retracted position, the operator grips 102 will rest in the opening 84 in the forward ends of the stock. FIG. 22 shows such an opening 84 for a collapsible-type stock 62. It should be recognized that the standard-type stock also has this opening 84. When in the retracted position, at least a portion of the operator grip 102 will reside in opening 84. The rear edge 176 of the operator grip 102 will engage the side 178 of opening 84.

Due to the length of the operator grip 102 and the plunger retractor 98, the opening 84 will be closed when the operator grip 102 is in the retracted position. In that manner, dirt, sand or other debris cannot fall into the opening 184 and jam the operation of the plunger retractor 98. When it is desired to retract plunger 94, it is simply necessary to pivot the operator grips 102 to the extended position. Then, the rear ends 176 will no longer engage the sides 178 of opening 84. The operator grips 102 can then be held and pulled rearwardly thereby simultaneously pulling the plunger retractor 98 and plunger 94 into the plunger housing 140. This will withdraw the plunger 94 from a plunger receiving opening 111 in receiver 58. When the operator releases grips 102, the force of spring 92 will cause plunger 94 to assume its extended position. This extended position will be considered a first position whereas the position in which the plunger 94 is within housing 140 will be considered a second position.

As noted above, each side of the stock 60 has an opening 84 through which the plunger retractor 98 extends. Each of these sides of the plunger retractor 98 will have a first operator grip 102 attached thereto. Therefore, both sides of the stock have an operator grip. It is necessary to move both operator grips from the retracted to the extended positions before the plunger 94 can be retracted. By positioning the operator grips 102 in the retracted positions such that their rear edges 176 engage sides 178, the plunger 94 will be locked in the first or extended position. Therefore, if the plunger 94 is in a plunger receiving 111, rotation of the stock 60 relative to the receiver 58 is prevented.

In the cross-sectional view of the collapsible-type stock shown in FIG. 22, the housing 104 is shown with the plunger housing 140, tube 82, track 106 and opening 130. This opening 130 is similar to the opening of the FIG. 12 stock 118. A molded front wall 128 forms this opening 130 for receiving the cap 78 and at least a portion of the shaft 80. Of course, the opening 130 has the same shape as the face of cap 78.

Behind front wall 128 is a threaded section 504 for receiving the housing plug 108. Instead of having this molded front wall 125 and molded threaded section 504, the housing 104 can have an insert similar to the stock insert 120 of FIG. 9.

As previously mentioned, the track 106 of the housing 104 of FIG. 22 has three counterbores therein which form stops 506, 508 and 510. The plunger 500 on the rear end portion 107 (FIG. 7) of the stock can rest in one of these stops 506, 508 or 510 in order to hold the collapsible-type stock in one of three positions. To move the stock between positions, handle 502 can be moved to withdraw the plunger 500 from one of the stops 506, 508, 510. The housing 104 can then be moved relative to the end portion 107.

Returning to FIG. 6, operation of the detachable stock system will be described. As previously noted, the extension 74 can be mounted on either a receiver 58 or a stock 60. A tube 82 is provided in a standard-type stock 64 or housing 104 of a collapsible-type stock 62 when the extension 74 is mounted on the receiver 58. The tube 82 of the standard-type stock or collapsible-type stock will receive the extension 74. The cap 78 at the end of extension 74 is slid into an opening 124 or 130 provided at the rear of tube 82. This cap 78 will be aligned with opening 124 or 130 when the median plane of the receiver is generally perpendicular to the median plane of the stock and when the longitudinal axes of the receiver and stock are generally parallel. In other words, the stock is slid over the extension 74. This stock is initially positioned 90° relative to receiver 58.

After the extension 74 is fully received within tube 82, the cap 78 will be beyond opening 124, 130. Then, the stock will be rotated 90° relative to the receiver. Accordingly, the median plane of both the stock and receiver will be generally aligned. The cap 78 will be locked in position behind the wall 122 or 128 in the tube 82. This will prevent the stock 60 from separating from the receiver 58.

Before the stock is rotated relative to the receiver, the plunger 94 must be retracted. In the arrangement described with reference to FIGS. 17–21, the first operator grip 102 is moved to the extended position, the operator grip is then pulled rearwardly in order to move plunger retractor 98 and retract plunger 94 within housing 140. Therefore, the plunger 94 will not engage the opening in the receiver portion 58 and will therefore not interfere with rotation of the stock relative to the receiver. Once the plunger 94 is within housing 140, the stock can be rotated 90° relative to the receiver 58.

Figure 2:
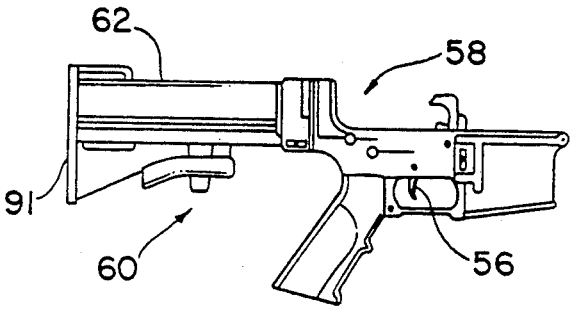
FIG. 2 is a side view of a receiver with a retracted collapsible-type stock mounted thereon.
Figure 3:
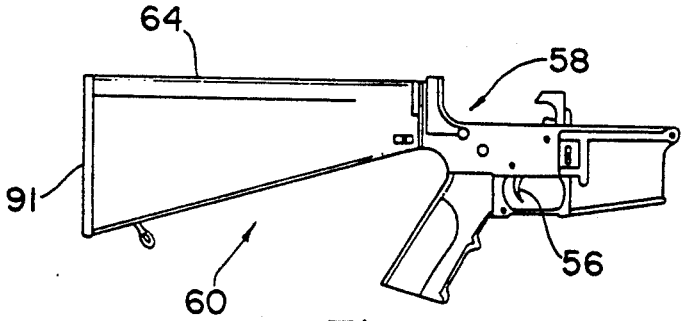
FIG. 3 is a side view of a receiver with a standard-type stock mounted thereon.

When viewing the weapon shown in FIGS. 2 and 3, it should be recognized that the stock 60 can be rotated clockwise or counterclockwise in order to mount the stock 60 to the receiver 58. This arrangement enables a right-handed or left-handed person to easily use the instant invention. Because of the symmetry of the shape of the cap 78 and opening 124,130, this arrangement is easily permitted.

Once the cap 78 and a portion of the shaft 80 are received within the latch member 114 and the stock 60 is rotated relative to the receiver 58, the plunger 94 will snap into position. Spring 92 will force plunger 94 into the plunger receiving opening 111 in the receiver 58. This automatic feature ensures locking of the receiver relative to the plunger. Once the plunger has been received in the opening 111, rotation of the stock 60 relative to the receiver 58 is prevented. The first operator grip 102 can then be returned to the retracted position in order to lock the plunger 94 in the receiver 111. This will ensure that the plunger 94 does not accidentally become detached thereby avoiding unwanted rotation of the stock relative to the receiver.

In order to detach the stock 62 from the receiver 58, it is simply necessary to move the operator grips 102 from the retracted to the extended portion Then, the grips are pulled rearwardly in order to move the plunger retractor 98 rearwardly. This automatically causes plunger 94 to move rearwardly against the bias of spring 92. Once the plunger 94 has been removed from opening 111 in receiver 58, the stock 60 can be rotated 90°. When the stock 60 reaches this position, the shape of the cap 78 on extension 74 will match the shape of opening 124 or 130. The portion of the shaft 80 and the cap 78 within the locking means 114 can be slid therefrom. The extension 74 will be removed from tube 82. In this manner, the stock 60 and receiver 58 can quickly be detached.

This attaching and detaching can be carried out very quickly. For example, to attach or detach a stock to a receiver using the present design takes approximately 15 or 20 seconds. In the prior art arrangements, it would take at least 15 minutes in order to exchange a stock of a weapon. Therefore, it is very quick to use the instant system.

Figures 23, 24, 25, 26, 27, 28, 29, 30, 31, 32, 33:
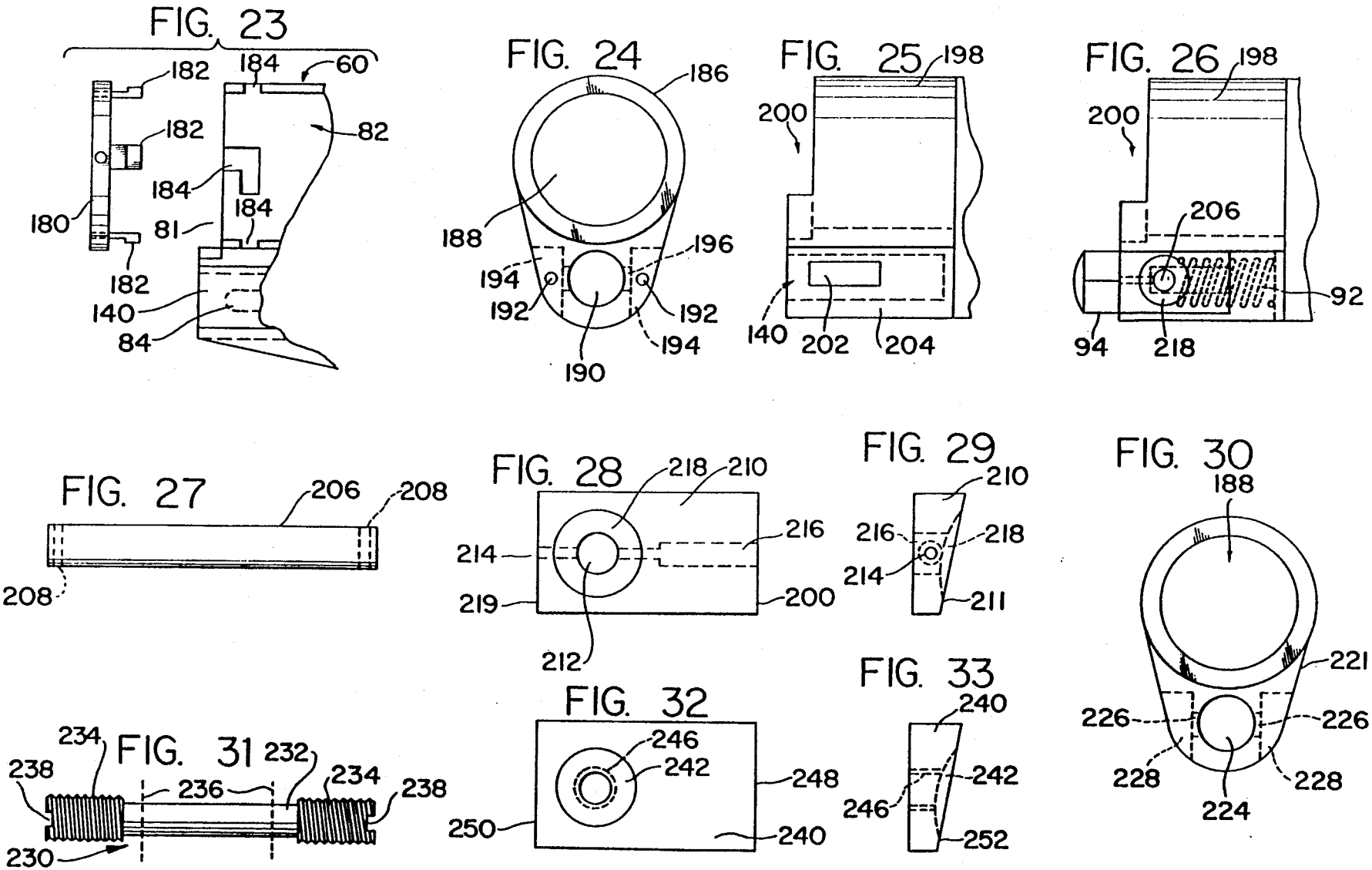
FIG. 23 is a cut-away view showing a first modified form of a receiver end plate and an end portion of a stock of the present invention.
FIG. 24 is a front view of a second modified receiver end plate of the present invention.
FIG. 25 is a side view of a modified stock end which uses the second modified receiving end plate of FIG. 24 of the present invention.
FIG. 26 is a side view showing the modified stock end of FIG. 25 with a plunger and slide.
FIG. 27 is a plan view of a plunger retractor used with the second modified receiver end plate of FIG. 24 of the present invention.
FIG. 28 is a side view of a slide plate used with the second modified receiver end plate of FIG. 24 of the present invention.
FIG. 29 is an end view of the slide plate shown in FIG. 28.
FIG. 30 is a front view of a third modified receiver end plate of the present invention.
FIG. 31 is a plan view of a plunger retractor used with the third modified receiver end plate of FIG. 30 of the present invention.
FIG. 32 is a side view of a modified slide plate used with the third modified receiver end plate of FIG. 30 of the present invention.
FIG. 33 is a side view of the slide plate shown in FIG. 32.

Turning now to FIG. 23, a modified form of the receiver end plate 180 is shown. This modified receiver end plate 180 has catches 182 on the rear side thereof. These catches 182 will engage in slots 184 on stock 60. If the stock 60 is rotated after catches 182 are inserted into slots 184, the end plate 180 can be locked to the stock 60. This arrangement therefore provides for quick attachment and detachment of the receiver end plate and stock 60.

Turning now to FIGS. 24–29, a second modified receiver end plate 186 will be described. This end plate 186 has an opening 188 for extension 74 similar to the previously described receiver end plate 70. Also, an opening 190 is provided for plunger 194. However, the sides of this receiver end plate 186 have cutouts 194. Also, openings 192 which are generally parallel to the longitudinal axis are provided in this receiver 186. A transverse opening 196 is also provided through both sides of the receiver into the opening 190.

Turning now to FIG. 25, a modified stock end 198 is shown. This modified stock end 198 has a cut-off portion 200 similar to the cut-off portion 81 of the above-described stocks. A transverse opening 202 is also provided but this stock end 198 also includes a slide opening 204. This transverse opening extends completely through the modified stock end 198. This slide opening 204 is a recess within the end of the stock 198. Positioned within the slide opening 204 will be a slide plate 210 as shown in FIG. 28. The length of the slide plate 210 is less than the length of the slide opening 204 such that reciprocation of the slide 210 is permitted. The slide plate 210 has a small longitudinal opening 214 extending to an enlarged opening 216. The alignment of these openings 214,216 is shown in FIG. 29. When positioned in the slide opening 204 and when the modified receiver end plate 186 is positioned on the end 198 of the stock, the longitudinal openings 192 in each side of the receiver end plate 186 will be aligned with the openings 214 and 216 in slide plates 210 on each side of the stock 198. Accordingly, a slide plate 210 will be provided in a slide opening 204 provided on each side of the stock 198.

In FIG. 27, a rod 206 or first modification for the plunger retractor is shown. This rod 206 has end grooves 208. In order to assemble the arrangement shown in FIGS. 24–29, a spring 92 is inserted into plunger housing 140. Then, the spring 94 is pressed against the plunger 94. The rod 206 can be inserted through transverse opening 202 on one side of the stock, through the transverse opening 96 on the plunger 94 and out of the other transverse opening 202 on the other side of the stock 198. The slide plates 210 can be placed in each of the openings 204 with the ends of rod 206 extending through the transverse openings 212. The plunger will then be held within the housing 140 by the rod 206. In order to maintain the position of the rod, a pin will be inserted through the longitudinal groove 192 of the receiver end plate 196 and the smaller groove 214 of the slide plate 210. This pin will extend through the end groove 208 on one side of rod 206. The pin will fall into the enlarged opening 216 while maintaining its positioning in the end groove 208. A pin will be inserted through each longitudinal opening 192, each end groove 208 and each slide plate 210 on both sides of the stock 60. In that manner, the rod 206 will not slip out of opening 202 and will be held securely in position.

As seen in FIGS. 28 and 29, a grip recess 218 is provided on slide plate 210. This grip recess will enable an operator to easily hold the slide plate 210. The above-noted cutouts 194 on the receiver end plate 186 will avoid interference of an operator's gripping the slide plate 210. This slide plate 210 acts as a second operator grip similarly to the first operator grip 102. In particular, an operator can grasp recess 218 of slide 210 in order to pull the slide 210 rearwardly. This movement will cause rod 206 to move rearwardly in transverse openings 202. This movement moves plunger 94 rearwardly against the bias of spring 92. In this manner, the plunger 94 can then be retracted into the plunger housing 140 and the stock can be rotated relative to the plunger. As noted above, the slide 210 is provided on each side of the housing. The operator can grip each of the slides with his or her finger and thumb. Once the operator releases the slide 210, the spring 92 will cause the plunger 94 to return to the extended position.

It should be noted that the slide 210 has a sufficient size to cover transverse opening 202. In this manner, sand, dirt or other debris will not enter the plunger housing 140 and interfere with operation of the plunger 94.

Turning now to FIGS. 30–33, a third modified receiver end plate 221 is shown. This receiver end plate 221 has an opening 188 for the extension 74 and an opening 224 for the plunger 94. A transverse opening 226 is provided through both sides of the receiver end plate 221 and the plunger opening 224. Cutouts 228 are also provided on the sides of the receiver end plate 221 similar to the receiver end plate 186 shown in FIG. 24.

A shaft 230 is shown in FIG. 31. This shaft 230 includes a shank 232 and enlarged threaded ends 234. The plunger 94 will be positioned between the enlarged ends 234 as indicated by the dotted lines 236. Screwdriver recesses 238 are provided at the threaded ends 234 of the shaft 230.

Similar to the slide plate 210, a modified slide plate 240 is provided in this arrangement. This slide plate 240, however, does not have the smaller and enlarged openings 214,216 of the previously described slide plate 210. A grip recess 242 is provided in the slide plate 240. This slide plate 240 will be mounted in a slide opening 204 of a stock as seen in FIG. 25. The modified slide plate 240 is dimensioned so that it can reciprocate within this slide opening 204.

A threaded interior 246 is provided such that the shaft 230 can be screwed through the slide plate 240. This shaft will engage the modified slide plates 240 on both sides of the stock 60. After being inserted into the stock end 198, the ends of shaft 230 can be flattened to prevent removal of shaft 230 from the opening 96 in plunger 94.

When an operator wants to withdraw plunger 94, he or she will simply grasp the slide 240 and move it rearwardly. This will cause shaft 230 to move rearwardly in order to retract the plunger 94.

It is noted that the plunger 94 used with the rod 206 or shaft 230 does not have to have a counter bore 154. Rather, spring 92 can simply rest against the back of the plunger 94. Provision of this spring 92 will help prevent side-to-side movement of plunger retractor 98, rod 206 or shaft 230 even if the first operator grip 102, the slide plate 210 or the modified slide plate 240 breaks off or is otherwise removed.

When the plunger 94 is in the extended position, the forward end 219 of the slide plate 210 or the forward end 250 of the modified slide plate 240 will engage the front wall of slide opening 204. These slide plates 210 have rear ends 220,248 respectively. As seen in FIGS. 29 and 33, an outer edge 211,252 of the slide plates is sloped. This will help to maintain the streamlined nature of the stock.

The present system provides a detachable stock system in which a stock 60 can quickly be attached to or detached from a receiver 58. As noted above, many different configurations for this arrangement can be carried out. This system is reliable, requiring limited maintenance and is relatively inexpensive. The system is readily usable by both a right-handed or left-handed person. Few alterations are needed for existing weapon systems such that the instant system is readily adaptable to existing weapons. A collapsible-type stock (CAR), a standard-type stock, a shotgun stock, a pistol grip or any other variety of stocks can be used with this system. Moreover, the present system can be used on many different types of receivers.

An additional benefit of the instant system is that the length of the collapsible-type stock 62 is slightly increased. when in an extended position as shown in FIG. 1, the collapsible-type stock 62 will be the same length as a standard stock 64. Provision of the plunger housing 104 and other components at the forward end of housing 104 increases the length of the collapsible-type stock 62 about one-half inch. Therefore, this stock 62 feels more natural to a user. Current collapsible-type stocks are slightly shorter and therefore have an unnatural feeling for some users. In fact, these conventional collapsible-type stocks can feel like a toy, especially to a tall person with long arms. Due to the collapsible-type stock 62 length increase, the instant system avoids such problems.

Throughout the specification, the plunger 94 has been discussed as being on the stock 60. However, this arrangement can be reversed with the plunger 94 and associated mechanisms being on the receiver 58 and the plunger housing 140 being on the stock. Thus, the plunger 94 can be on either the stock 60 or receiver 58 similarly to the extension 74. Placement of the extension 74 and plunger 94 are independent of each other such that the plunger 94 could be on the stock 60 while the extension 74 is on the receiver 58 or vice versa or the plunger 94 and extension 74 can both simultaneously be on the stock 60 or receiver 58.

The method of the present invention will now be discussed. In this method, an extension 74 on a stock 60 or receiver 112 will be inserted into a latch member 114 on the other one of the stock or receiver. The plunger 94 on the stock 60 or receiver 112 will be retracted. The stock 60 will then be rotated relative to the receiver 58 such that the plunger 94 will be aligned with an opening in the receiver or stock. The plunger 94 then will be released into the opening. Rotation of the stock relative to the receiver will then be prevented. Further, separation of the stock and receiver will be prevented due to the latch member 114 and cap 78 of the extension 74 interlocking. If a first operator grip 102 is provided, the ears of grip 102 can be moved from an extended to a retracted position in order to lock the plunger 94 into the opening in the receiver.

In order to detach the stock from the receiver, the ears of the first operator grip 102 are moved from the retracted to the extended position and the plunger retractor 98 is then pulled backwardly in order to withdraw plunger 94 from the opening. If this first operator grip 102 is not used, a slide plate 210 or 240 can be gripped by the operator and moved rearwardly in order to retract the plunger 94 from an opening in the receiver. Once this plunger 94 is out of the opening in either the receiver or stock, the stock 60 can be rotated 90° relative to the receiver 58. The cap 78 of the extension 74 can then be removed from the latch member 114. The extension 74 is removed from the tube 82 of the stock if a tube-type stock is used. In this manner, the stock can be quickly removed from the receiver.

As noted above, a receiver and stock can quickly be attached and detached by the instant system and method. Other benefits of the instant invention and modification should be apparent to those skilled in the art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A detachable stock system comprising:

a receiver;

a stock;

mounting means comprising an extension and a latch member for detachably mounting the receiver to the stock, the extension being provided on one of the receiver and the stock and the latch member being provided on the other one of said receiver and stock; and locking means movable between a first position and a second position for preventing rotation of the stock relative to the receiver when in the first position and for permitting rotation of the stock relative to the receiver when in the second position when the stock is mounted on the receiver, the locking means being provided on an end of one of the stock and receiver, the ends of the stock and receiver being adjacent one another when the stock is mounted on the receiver.

2. The detachable stock system as recited in claim 1, wherein the extension has two ends, one end having a shaft and cap attached thereto and the other end being mounted to the receiver, the locking means being in the stock and receiving the cap and a portion of the shaft when the stock is mounted to the receiver, the stock being twisted relative to the receiver in order to lock the cap in the latch member when the stock is mounted to the receiver.

3. The detachable stock system as recited in claim 1, wherein the extension is mounted to the stock, an end of the extension having a shaft and a cap provided thereon, the latch member being provided on a retractor and receiving the cap and a portion of the shaft when the stock is mounted to the receiver, the stock being twisted relative to the receiver in order to lock the cap in the latch member when the stock is mounted to the receiver.

4. The detachable stock system as recited in claim 1, wherein the stock is one of a collapsible and non-collapsible stock.

5. The detachable stock system as recited in claim 1, wherein the extension has a first and second end, the first end of the extension being mountable to the one of the receiver and the stock and the second end having a shaft and cap extending therefrom, the cap being mounted at an end of the shaft, the extension being within one of the stock and the receiver when the stock is mounted to the receiver.

6. The detachable stock system as recited in claim 5, wherein the mounting means further comprises a receiver end plate positioned between the extension and the receiver when the extension is mounted on the receiver, the receiver end plate having a first opening defined therein through which the extension passes and having a detent insertable in the receiver for preventing rotation between the receiver end plate and the receiver.

7. The detachable stock system as recited in claim 6, wherein the receiver end plate further has a second opening defined therein, the locking means includes a plunger extendable from and retractable into the stock, the plunger extending through the second opening of the receiver end plate when extended and when the stock is mounted on the receiver.

8. The detachable stock system as recited in claim 6, wherein the mounting means further comprises a receiver extension nut positioned between the receiver end plate and the extension when the stock is mounted on the receiver.

9. The detachable stock system as recited in claim 5, wherein the extension is detachably mounted on the receiver and wherein the stock has a tube defined therein, the tube extends in a longitudinal direction of the stock, the latch member comprises a stock insert positioned in the tube of the stock, the stock insert being detachable from the stock, a forward end of the stock insert having an opening defined therein, the opening receiving the cap and at least a position of the shaft of the extension when the stock is mounted on the receiver.

10. The detachable stock system as recited in claim 9, wherein the receiver and the stock both have median planes extending in longitudinal directions thereof, the median planes being generally perpendicular just before the stock is mounted on the receiver and being generally parallel when the stock is mounted on the receiver, the opening in the forward end of the stock insert and a face of the cap having generally a same shape such that the cap can be inserted through the opening when the median planes are generally perpendicular and the cap is unable to pass through the opening when the median planes are generally parallel, whereby the cap and the portion of the shaft can pass through the opening as the stock is being mounted on the receiver and whereby the cap is held within the stock insert when the stock is mounted on the receiver to thereby hold the stock to the receiver.

11. The detachable stock system as recited in claim 9, wherein an end of the stock insert is threaded and wherein the system further comprises a stock plug having a neck, a screw and a stock end plate, the stock plug being screwed into the threaded end of the stock insert, the stock end plate being positioned over the neck of the stock plug and being attached by the screw to mount the stock end plate to the end of the stock.

12. The detachable stock system as recited in claim 5, wherein the extension is detachably mounted on the receiver and wherein the stock has a tube defined therein, the tube extends in a longitudinal direction of the stock, the latch member comprises a wall rigidly fixed in the tube with an opening defined therein, the opening receiving the cap and at least a position of the shaft of the extension when the stock is mounted on the receiver.

13. The detachable stock system as recited in claim 12, wherein the receiver and the stock both have median planes extending in longitudinal directions thereof, the median planes being generally perpendicular just before the stock is mounted on the receiver and being generally parallel when the stock is mounted on the receiver, the opening in the wall in the tube and a face of the cap having generally a same shape such that the cap can be inserted through the opening when the median planes are generally perpendicular and the cap is unable to pass through the opening when the median planes are generally parallel, whereby the cap and the portion of the shaft can pass through the opening as the stock is being mounted on the receiver and whereby the cap is held by the wall in the tube when the stock is mounted on the receiver to thereby hold the stock to the receiver.

14. The detachable stock system as recited in claim 12, wherein an end of the tube is threaded and wherein the system further comprises a stock plug having a neck, a screw and a stock end plate, the stock plug being screwed into the threaded end of the tube, the stock end plate being positioned over the neck of the stock plug and being attached by the screw to mount the stock end plate to the end of the stock.

15. The detachable stock system as recited in claim 1, wherein the locking means comprises a plunger, a plunger retractor and an operator grip all movable between the first position and the second position, the plunger retractor being attached to the plunger and to the operator grip, the plunger extending from a forward end of the stock when in the first position and being retracted into the stock when in the second position, the receiver having an opening defined therein to receive the plunger when the stock is mounted on the receiver.

16. The detachable stock system as recited in claim 15, wherein the stock has a housing defined in the forward end thereof for receiving the plunger and a spring, the spring urging the plunger toward the first position.

17. The detachable stock system as recited in claim 15, wherein the plunger has a transverse opening defined therein for receiving the plunger retractor, the plunger retractor extending through the plunger in a direction generally perpendicular to a longitudinal axis of the stock.

18. The detachable stock system as recited in claim 17, wherein the operator grip comprises a pair of ears pivotally mounted on the plunger retractor, one ear being positioned on each side of the plunger retractor such that an ear is provided on each side of the stock, the plunger retractor having a slot defined on each side for receiving the ears, the ears being pivotal on the plunger retractor between an extended position and a retracted position, the stock having an opening therein through which the plunger retractor passes, a wall of the opening being engaged by the ears when the ears are in the retracted position such that movement of the plunger and plunger retractor is prevented, and the wall of the opening being free of the ears when the ears are in the extended position such that the plunger and plunger retractor are free to move between the first and second positions.

19. The detachable stock system as recited in claim 18, further comprising detents provided in each of the slots in the plunger retractor, the detents holding the ears in either the extended or retracted position, the ears being independently pivotable.

20. The detachable stock system as recited in claim 17, wherein the operator grip comprises a slide mounted on each side of the plunger retractor, the stock having an opening therein through which the plunger retractor passes, the opening having an enlarged outer portion on both sides of the stock, the slides being reciprocable in the enlarged outer portions and the slides having a size sufficient to cover the opening through which the plunger retractor extends regardless of whether the locking means is in the first or second position.

21. The detachable stock system as recited in claim 20, wherein the plunger retractor is a rod extending through the plunger, the slides each having a longitudinal opening defined therein for receiving pins which extend through the rod to hold the slides to the rod.

22. The detachable stock system as recited in claim 20, wherein the plunger retractor is a shaft with threaded ends, the shaft extending through the plunger and being screwed to the slides to hold the slides on the rod.

23. A method for readily attaching a stock to and detaching the stock from a receiver comprising the steps of:

providing an extension on one of the stock and the receiver;

inserting the extension into a latch member on the other one of the stock and the receiver;

providing a retractable plunger on one of the stock and the receiver;

retracting the plunger into the one of the stock and the receiver;

rotating the stock relative to the receiver after the plunger is retracted;

aligning the plunger to an opening defined in the other of the stock and the receiver;

releasing the plunger to extend between the stock and the receiver;

preventing rotation of the stock relative to the receiver when the extension is inserted into the latch member and when the plunger extends into the opening; and preventing separation of the stock and receiver by the extension inserted in the latch member such that the stock is mounted to the receiver.

24. The method as recited in claim 23, further comprising the steps of:

retracting the plunger back into the one of the stock and the receiver after the stock is mounted to the receiver;

rotating the stock relative to the receiver after the plunger is retracted; and removing the extension from the latch member after the stock is rotated relative to the receiver in order to detach the stock from the receiver.

* * * * *